US006720491B1

(12) United States Patent
Kroncke

(10) Patent No.: US 6,720,491 B1
(45) Date of Patent: Apr. 13, 2004

(54) FOOT ACTUATED CYMBAL DAMPING APPARATUS AND METHOD

(76) Inventor: Kurt Kroncke, 933 S. Charles St., Baltimore, MD (US) 21230

( * ) Notice: Subject to any disclaimer, the term of this patent is extended or adjusted under 35 U.S.C. 154(b) by 0 days.

(21) Appl. No.: 10/209,129

(22) Filed: Jul. 31, 2002

Related U.S. Application Data

(60) Provisional application No. 60/309,341, filed on Aug. 1, 2001.

(51) Int. Cl.[7] ..... G10D 13/82
(52) U.S. Cl. ..... 84/422.3
(58) Field of Search ..... 84/422.1, 422.2, 84/422.3

(56) References Cited

U.S. PATENT DOCUMENTS

| | | | | |
|---|---|---|---|---|
| 3,185,014 A | | 5/1965 | Ross | |
| 4,216,696 A | | 8/1980 | Alexis | |
| 4,510,838 A | * | 4/1985 | Alexis, Jr. | 84/422.3 |
| 4,776,254 A | | 10/1988 | Cruz | |
| 5,266,733 A | | 11/1993 | Jacobson | |
| 5,637,819 A | | 6/1997 | Rogers | |
| 5,922,980 A | | 7/1999 | Arteaga | |
| 5,959,227 A | | 9/1999 | Shapiro | |
| 5,986,197 A | | 11/1999 | Allen | |
| 6,239,343 B1 | * | 5/2001 | Hoshino | 84/422.3 |

* cited by examiner

*Primary Examiner*—Kimberly Lockett
(74) *Attorney, Agent, or Firm*—Liniak, Berenato & White, LLC

(57) ABSTRACT

A vibration dampening apparatus and method for dampening vibration of a resonating instrument such as a cymbal, cow bell, wood block or the like, in a controlled manner. A vibration dampener is mounted adjacent the resonating instrument to engages the resonating instrument at a plurality of points simultaneously to absorb and deaden vibration. According to a preferred embodiment, a cymbal damping apparatus is mounted onto a structure resembling a drummer's hi-hat cymbal stand and substitutes a lower damping member in place of what, for a hi-hat, would customarily be the bottom cymbal. The foot actuated cymbal damping apparatus dampens or deadens the cymbal's ring or vibration via application of a padded damping surface to the peripheral edge of the cymbal, which then immediately absorbs and dampens the vibrations and sound of the cymbal. By engaging a cymbal near its periphery with a plurality of spaced padded damping pads, any cymbal vibration is immediately and instantaneously damped to silence without a metal-on-metal sound as is normally heard when a hi-hat is closed.

14 Claims, 8 Drawing Sheets

FOOT ACTUATED CYMBAL DAMPING APPARATUS AND METHOD

PRIOR APPLICATION INFORMATION

This is a continuation of U.S. provisional application serial number 60/309,341 filed Aug. 1st, 2001, the entire disclosure of which is incorporated herein by reference.

BACKGROUND OF THE INVENTION

1. Field of the Invention

The present invention relates to musical instruments and, more particularly, to control of percussion instruments such as cymbals as used in conjunction with drum sets and the like.

2. Discussion of the Prior Art

Drummers and other percussionists often use cymbals and other resonating structures which make sound when struck. Many percussionists perform using an array of percussion instruments arranged within the percussionist's reach; the most common configuration is the drum set. The cymbals are played in a manner similar to drums and are struck repeatedly by a drumstick or similar instrumentality specifically designed to render sounds from vibrations propagating within the cymbal. Some musical situations require that the cymbal vibrations and sound be muffled or dampened.

In the prior art, damping cymbal vibrations and stopping the vibrational movement of the cymbal was most often accomplished by squeezing the nearest edge of the cymbal between the thumb and fingers. This method for damping or quieting a cymbal's vibration provides an aesthetically desirable characteristic of muting the cymbals' sound without creating a dissonant clanking or clanging tone before silence is achieved. One drawback of using the prior art squeezing method is that one of the drummer's hands must be occupied in performing this squeezing/muting step and, preferably, the drummer has moved or changed grip on the drumstick, such that the thumb and fingers are available for squeezing. This rather awkward squeezing movement may undesirably detract from the percussionist's performance, e.g., on other percussion instruments arranged nearby. This method for cymbal damping also is not ideal in that a pinched cymbal continues to resonate for a time, although the resonance does decay more quickly to silence than for an undamped or un-pinched cymbal.

Other prior art musical instrument assemblies for use with percussion equipment have accomplished stopping the vibrational movement of the cymbal, but customarily introduce drawbacks of their own. For example, U.S. Pat. No. 4,216,696 to R. H. Alexis, discloses a cymbal stand and an assembly including a hemispherically shaped cymbal damper 26 mounted beneath the cymbal on a stand and positioned to be actuated by foot pedal 28. Damper 26 is used, preferably in conjunction with cymbal striker 19 to achieve what is described as a novel effect. Damper 26 is not capable of quickly or immediately muting the sound of cymbal 10, however.

U.S. Pat. No. 4,776,254 to J. P. Cruz, discloses a damper assembly for a cymbal including a hand-operated actuator 42 which effectively pinches cymbal 12 at a single point along the cymbal periphery by operation of opposing members 26 and 28. In essence, the cymbal damper assembly of Cruz substitutes a requirement that the drummer use one hand to manipulate remote actuator 42 for the traditional requirement that the drummer use one hand to squeeze opposite surfaces of the cymbal itself.

It is well known to modulate the tone of a cymbal by striking it with a second and opposable cymbal operable by a foot pedal or the like; such assemblies are customarily known as "hi-hats", such as those shown in U.S. Pat. No. 3,185,014 to Ross and U.S. Pat. No. 5,266,733 to Jacobson. Each of these prior art references disclose a slightly different take on the standard opposable cymbal hi-hat mechanism operable by a foot pedal or the like. Hi-hats produce a distinctive transient clang sound upon forcibly closing the opposable cymbals upon one another. This clanging operation is to be contrasted with muting the vibration of a single cymbal which, while vibrating, emits the characteristic cymbal tone.

There have been many other percussion instrument assemblies used to mute or damp vibrations. Examples of more modern prior art attempts include U.S. Pat. No. 5,637,819, to Rogers, U.S. Pat. No. 5,922,980 to Arteaga, U.S. Pat. No. 5, 959,227 to Shapiro, and U.S. Pat. No. 5,986,197 to Allen, all of which disclose a number of mechanisms for damping drum heads, cymbals and the like. None of these, however,. have achieved the cross purposes of permitting the drummer's hands to remain free while providing a satisfactory cymbal muting action with a standard (e.g., crash or ride) cymbal.

OBJECTS AND SUMMARY OF THE INVENTION

Accordingly, it is a primary object of the present invention to overcome the above mentioned difficulties.

The invention provides an apparatus and method for quickly and effectively dampening vibration of a resonating instrument such as a cymbal, cow bell, wood block or the like, in a controlled manner. The invention mounts a vibration dampening article adjacent the resonating instrument whereby the vibration dampening article engages the resonating instrument at a plurality of points simultaneously to absorb and deaden vibration.

According to a preferred embodiment, the cymbal damping apparatus of the present invention is mounted onto a structure resembling a drummer's hi-hat cymbal stand and substitutes a lower damping member in place of what, for a hi-hat, would customarily be the bottom cymbal. In the foot actuated cymbal damping apparatus of the present invention, the purpose of the present invention is to damp or deaden the cymbal's ring or vibration via application of a vibration absorbing padded damping surface to the peripheral edge of the cymbal, which then immediately absorbs and dampens the vibrations and sound of the cymbal.

The lower damping member is preferably made from a frusto-conical frame having a centrally disposed mounting collar at it's center; the collar has an axially aligned center hole and is connected to a circular rim having a substantially larger outer diameter via a plurality of radially aligned spokes disposed at an angle to connect circular rim to the mounting collar. A substantially circular hoop is attached to the rim and atop the hoop are a number of pads of vibration damping material, preferably made of padded terry-cloth fabric. By engaging a cymbal near its periphery with a plurality of spaced padded damping pads, any cymbal vibration is immediately and instantaneously damped to silence without a metal-on-metal sound as is normally heard when a hi-hat is closed.

Accordingly, the invention dampens vibration of a resonating article using pressure from a drummer's foot rather than using a clasping by the drummer's hand. Moreover, the arrangement of the vibration dampening article provides simultaneous engagement of the resonating member at a plurality of points, preferably near the member's periphery.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Turning now to FIGS. 1–6, a cymbal damping apparatus in accordance with the present invention is operable to damp, choke or deaden vibrations in a percussive cymbal 1 and preferably uses pressure from the drummer's foot. The cymbal damping apparatus and method of the present invention frees the drummer's hands by relieving the drummer of the requirement to clasp the cymbal with the hand, the most popular conventional method for damping a vibrating cymbal.

Figure 1:
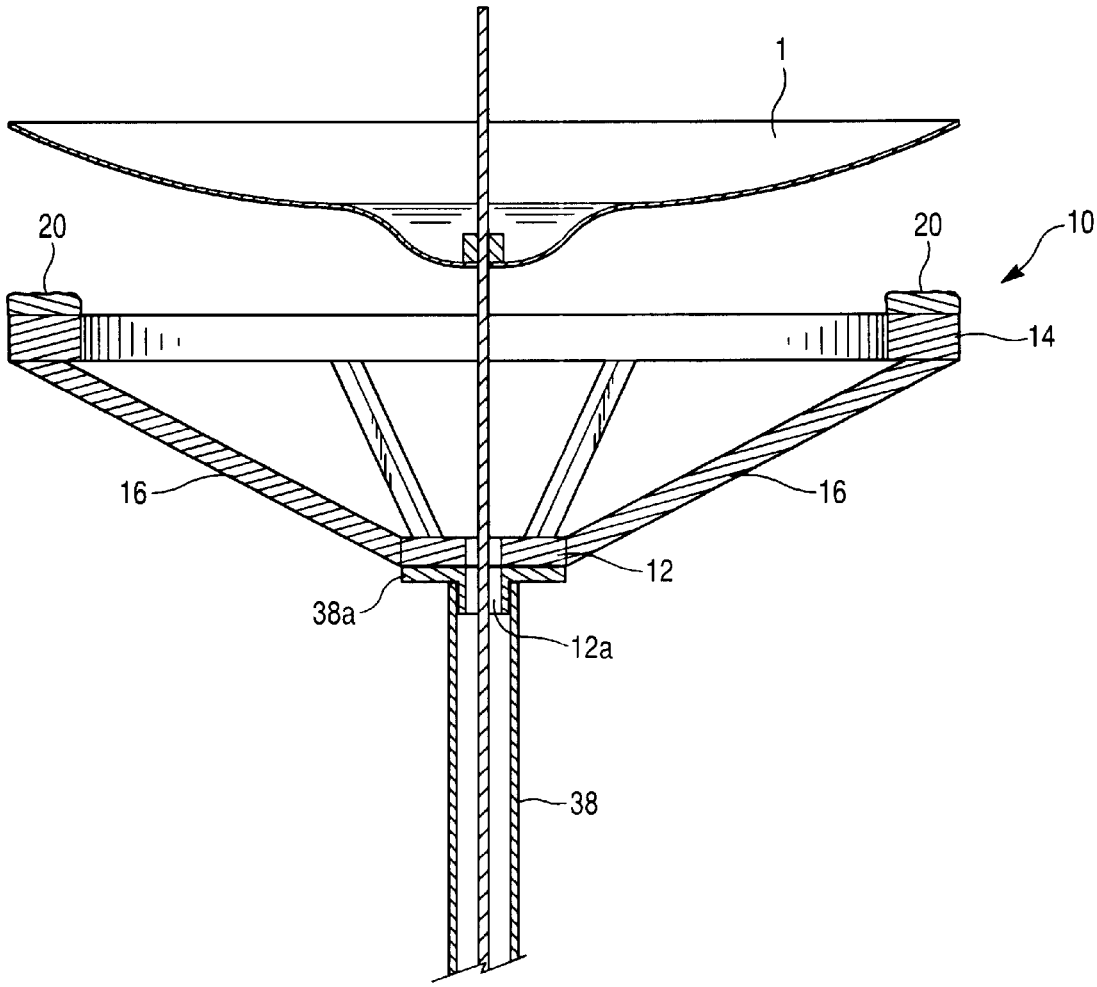
FIG. 1 illustrates, in cross section, the cymbal damping apparatus including the frame member and the cymbal, in accordance with the present invention.
Figure 3:
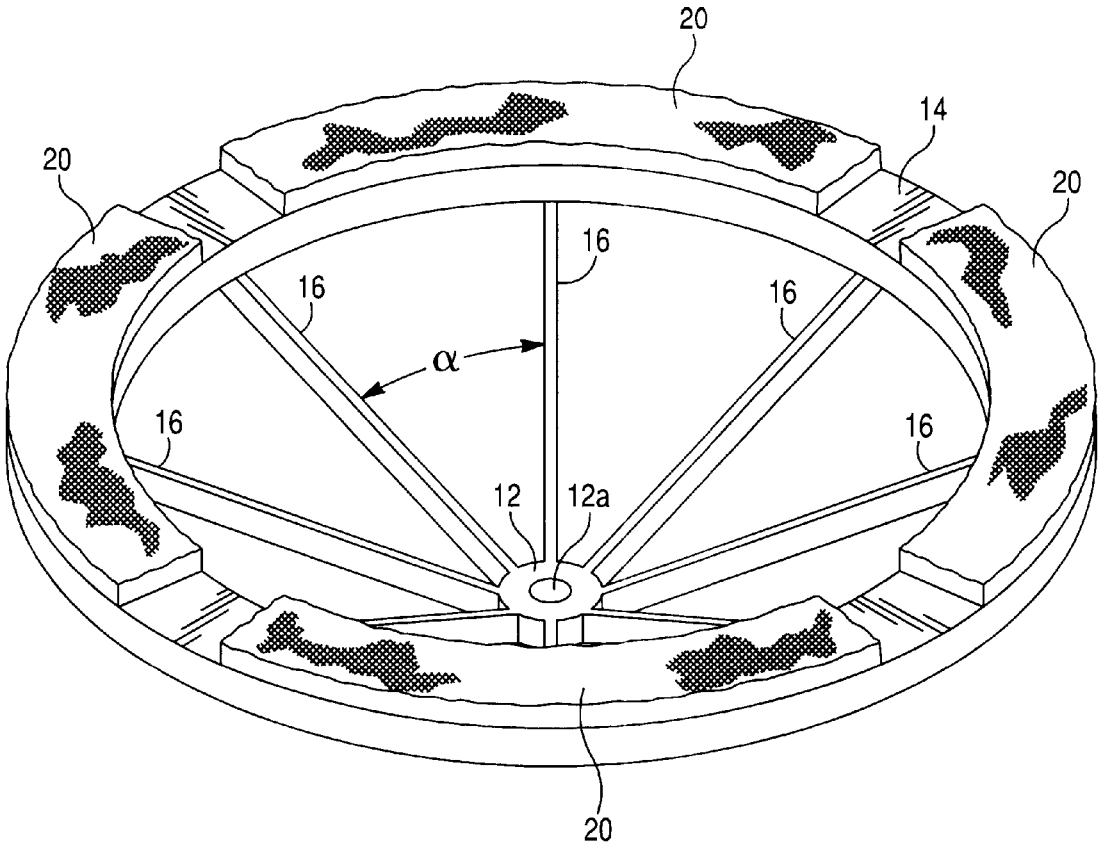
FIG. 3 is a perspective view of the cymbal damper of FIG. 1, in accordance with the present invention.

With reference to FIGS. 1 and 3, the damping member 10 is preferably made from a frusto-conical frame having a centrally disposed mounting collar 12 at it's center; the collar 12 has an axially aligned center hole 12*a* and is connected to a circular rim 14 having a substantially larger outer diameter than the collar 12 via a plurality of radially aligned spokes 16 disposed at an angle '$\alpha$' to connect the circular rim 14 to the mounting collar 12 (see FIG. 3). The circular rim 14 defines a substantially circular hoop and atop the rim 14 are a number of pads 20 of vibration damping material, preferably made of padded terry-cloth fabric, felt, plastic foam or another vibration absorbing material. By engaging a cymbal 1 near its periphery with the plurality of spaced padded damping pads 20, any cymbal vibration is immediately and instantaneously damped to silence without a metal-on-metal sound as is normally heard when a hi-hat is closed.

The invention is applicable to any resonating instrument, and the cymbal damping apparatus of the preferred embodiment comprises a mounting member 12 at the center of the damping apparatus for mounting the damper in spatial relation with respect to a cymbal 1. At least one support leg 16 extends in a radial direction from the mounting member 12, and a vibration damping material 20 is disposed on the terminal end of the support leg(s). The damping material 20 is adapted to engage the cymbal 1 during operation, preferably at the peripheral or free resonating end of the cymbal 1. The vibration damping material 20 is disposed at a plurality of points about a central axis of the cymbal 1 to simultaneous engage and dampen vibration of the cymbal 1.

In the preferred embodiment, the damping material is disposed at points that are equidistant from the central axis of the cymbal 1, and the vibration damping material is disposed in a generally circular configuration to match a corresponding circular configuration of the cymbal 1. As shown in FIG. 3, the damping material 20 may be disposed in a series of arcs uniformly disposed about the central axis.

As can be seen when referring to FIGS. 1, 2, 4, 7 and 8, the damping material engages the free resonating edge of the cymbal on one side only, namely, the bottom side that opposes the top side of the cymbal which the drummer will strike when playing.

Figure 2:
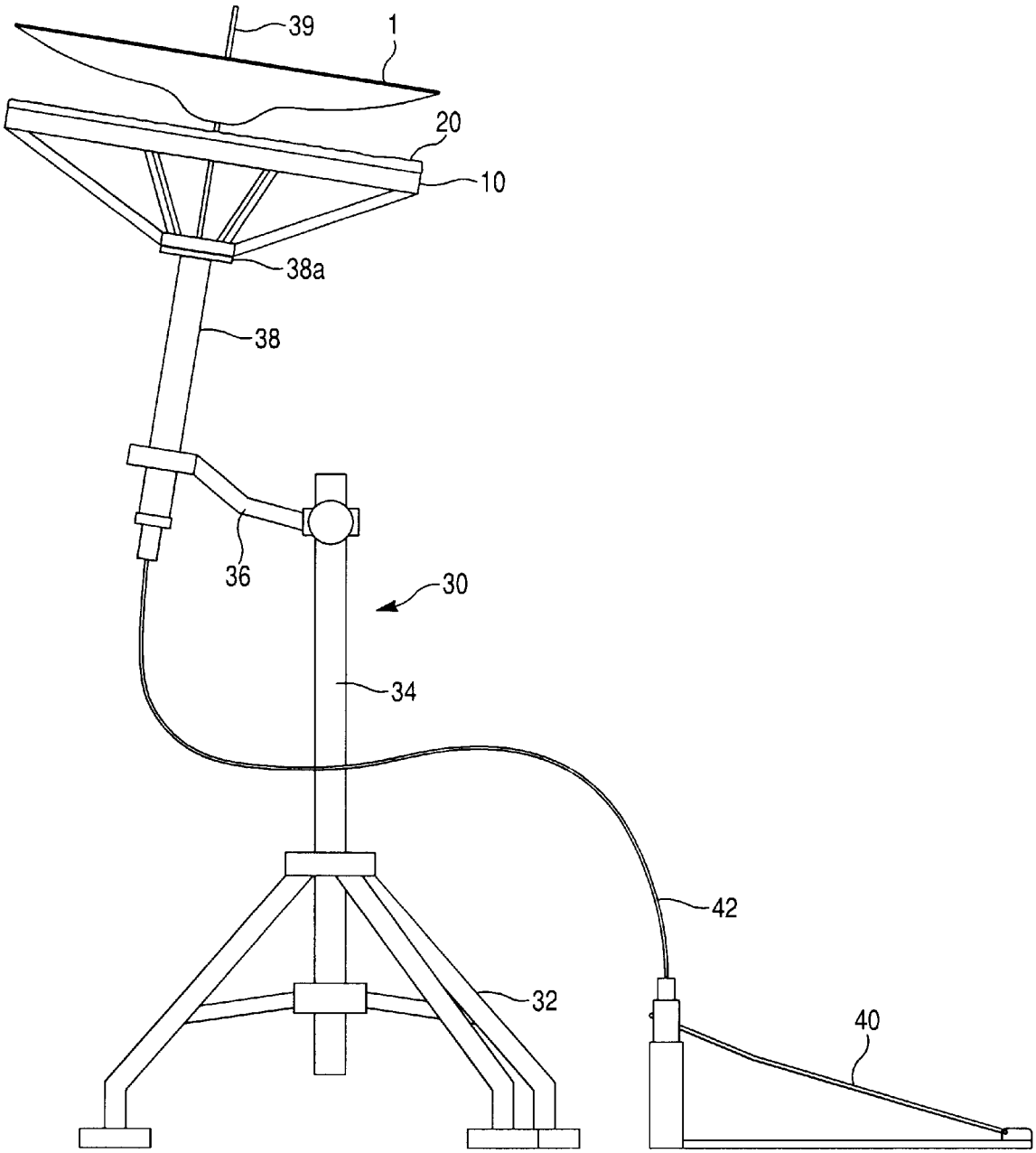
FIG. 2 is a side view, in partial cross section illustrating the frame assembly and remote cable actuated mechanism adapted for use with the actuating rod, in accordance with the present invention.

In the preferred embodiment shown in FIG. 2, the foot actuated cymbal damping apparatus of the present invention is mounted onto a structure resembling a drummer's hi-hat cymbal stand and substitutes a lower damping member in place of what, for a hi-hat, would customarily be the bottom cymbal. The foot actuated cymbal damping apparatus of the present invention can, for example, be used on the drummer's free-standing primary hi-hat stand, but is preferably implemented using a remote, cable operated secondary hi-hat stand such as the DW™ (Drum Workshop) brand 5500 TD Delta II or DW 7500, customarily used in tandem with a standard function hi-hat as would be understood by one of skill in the art.

The traditional hi-hat set-up employs specifically designed upper and lower cymbals of the same size (usually 14" diameter) paired opposite one another. The bottom cymbal remains stationary while the top cymbal is fastened to a rod running through a central lumen in the stand and attached to a spring-loaded foot pedal actuator. When downward pressure is applied to the foot pedal actuator, it pulls the two cymbals together to create a variety of sounds by way of interplay between the two cymbals.

A similar operative principle is employed in the foot actuated cymbal damping apparatus of the present invention, however, the purpose of the present invention is to damp or deaden the cymbal's ring or vibration via a lower damping device configured to apply a padded damping surface to the edge or other critical areas of the cymbal, which then immediately absorbs and damps the vibrations, and sound, of the cymbal.

More specifically, the foot operated cymbal assembly of this invention comprises a cymbal stand including a tripod base portion 32 supporting a vertical up-right member 34. A mounting bracket 36 mounts a support arm 38 with respect to the up-right member 34 and the tripod base portion 36. A cymbal 1 is mounted proximate to the top of the cymbal stand on a telescoping rod 39, and a cymbal vibration damper 10 is positioned on the support arm 38 for selective engagement with the cymbal 1.

Again, vibration damping material 20 is disposed at a plurality of points about a central axis of the cymbal to thereby simultaneously engage the cymbal 1 at more than one circumferential location. See FIGS. 3, 5 and 6.

A foot pedal 40 is positioned proximate to the bottom of the stand to move the cymbal 1 relative to said cymbal vibration damper 10 through a cable 42 operatively connecting the foot pedal 40 and the cymbal 1 through the telescoping rod 39.

With the assembly shown in FIG. 2, a method of damping a resonating cymbal is provided whereby a vibration dampening material 20 is disposed proximate the cymbal 1, and the position of the vibration dampening material is selectively adjusted relative to the cymbal 1 such that the vibration dampening material 20 contacts the cymbal 1 to absorb and dampen vibration of the cymbal 1. The step of selectively adjusting the position of the dampening material includes a step of engaging the cymbal 1 near its periphery whereby cymbal vibration is immediately and instantaneously damped to silence without a metal-on-metal sound.

One prototype built for experimentation and developmental purposes is made from the movable frusto-conical frame drum-head stretching member of a 18" Remo™ brand pitch adjustable (aka: Rototom) drum. The frusto-conical frame member has a centrally disposed mounting collar 12 at it's pinnacle having an axially aligned hole 12*a* and is connected to a circular rim 14 having a substantially larger outer diameter via a plurality of radially aligned spokes 16. The frusto-conical frame member circular rim may include a plurality of threaded holes that are spaced around the rim. The mounting collar is situated in a first plane, spaced from the plane of the circular rim and the spokes are disposed at an angle to connect circular rim 14 to the mounting collar 12, as shown in FIG. 3. A substantially circular hoop that is approximately ¾" thick and 1" wide is attached to the rim; the hoop is attached to the frusto-conical frame member via 4 standard tension key drum rods. Fastened to the top of the hoop are 4 damping pads preferably configured as pieces of vibration damping material, preferably made of padded terry-cloth fabric, felt, spongy elastomeric material, foam or the like. The hoop may be made of wood, metal, plastic or other polymer, or any other suitable material.

By engaging a cymbal near its periphery with a plurality of spaced padded damping pads, the cymbal vibration (induced by earlier having been struck with a drum stick or the like) is immediately and instantaneously damped to silence without a metal-on-metal sound as is normally heard when a hi-hat is closed.

The foot actuated cymbal damping frusto-conical frame member 10 is placed onto a high-hat stand, and the mounting collar 12 is facing down with the pull-rod 39 extending through the collar's center hole 12*a* so that it resembles a satellite dish pointed skyward. The foot actuated cymbal damping frusto-conical frame member 10 is preferably used with a cymbal 1 of the same, or slightly larger diameter as the circular rim 16 for the prototype shown, and an up-right (FIG. 8) or inverted (FIGS. 1–7) 18" china-type cymbal 1 is used.

Using the same method of construction as the prototype, various sizes are possible to accommodate a variety of cymbals, and while the prototype effectively performs the assigned task, there are a number of ways to construct a device that achieves the same, or a similar, effect. The foot actuated cymbal damping frusto-conical frame member can also be configured with surfaces other than a dampener to achieve different sounds.

Figure 4:
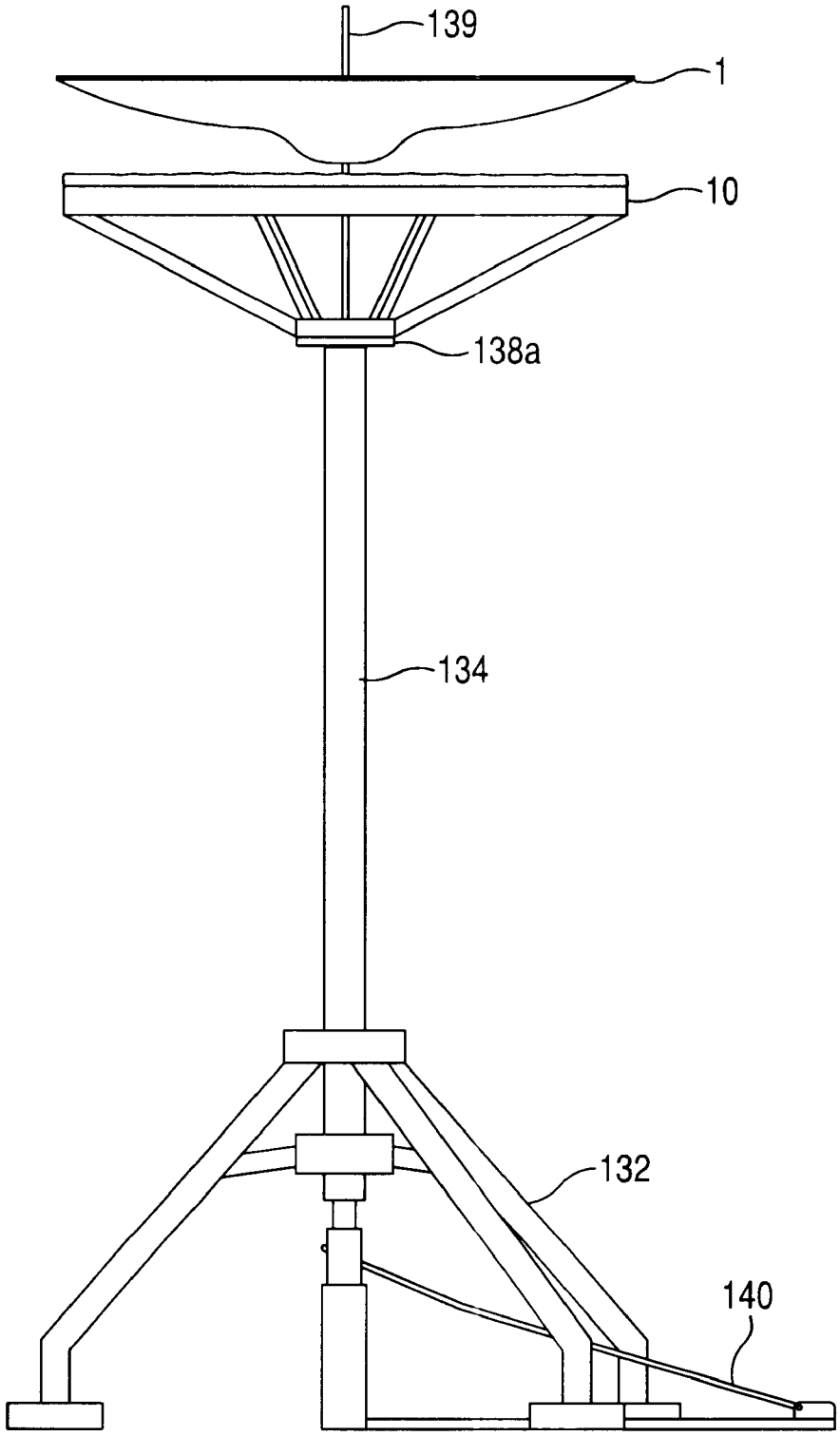
FIG. 4 is a side view of an alternate mechanism including the foot pedal actuator, a rigid telescoping actuating rod, the frustoconical frame member, and cymbal, in accordance with the present invention.

Turning now to the entire assembly as configured in the preferred embodiment, and referring now to FIG. 2 and FIG. 4, the foot actuated cymbal damping apparatus in the present invention includes a vertical stand 34, 134 supported on a foldable tripod 32, 132 and supporting a substantially horizontal damping frame member 10. The remote operable hi-hat assembly-like mechanism includes a foot pedal actuator 40, 140 which, in FIG. 2, draws a cable 42 through a flexible cable jacket to actuate a remotely located pull-rod affixed at its distal end to an inverted cymbal (e.g., a china-type crash or ride cymbal) 1. In the embodiment shown in FIG. 4, the flexible cable 42 is replaced with a rigid telescoping rod 139 linked to the foot pedal actuator 140.

The damping frame member 10 is rigidly supported and clamped in place via the collar 38*a*, 138*a* to provide an upwardly facing padded surface disposed on the frame member rim 14, as described above.

Figure 5:
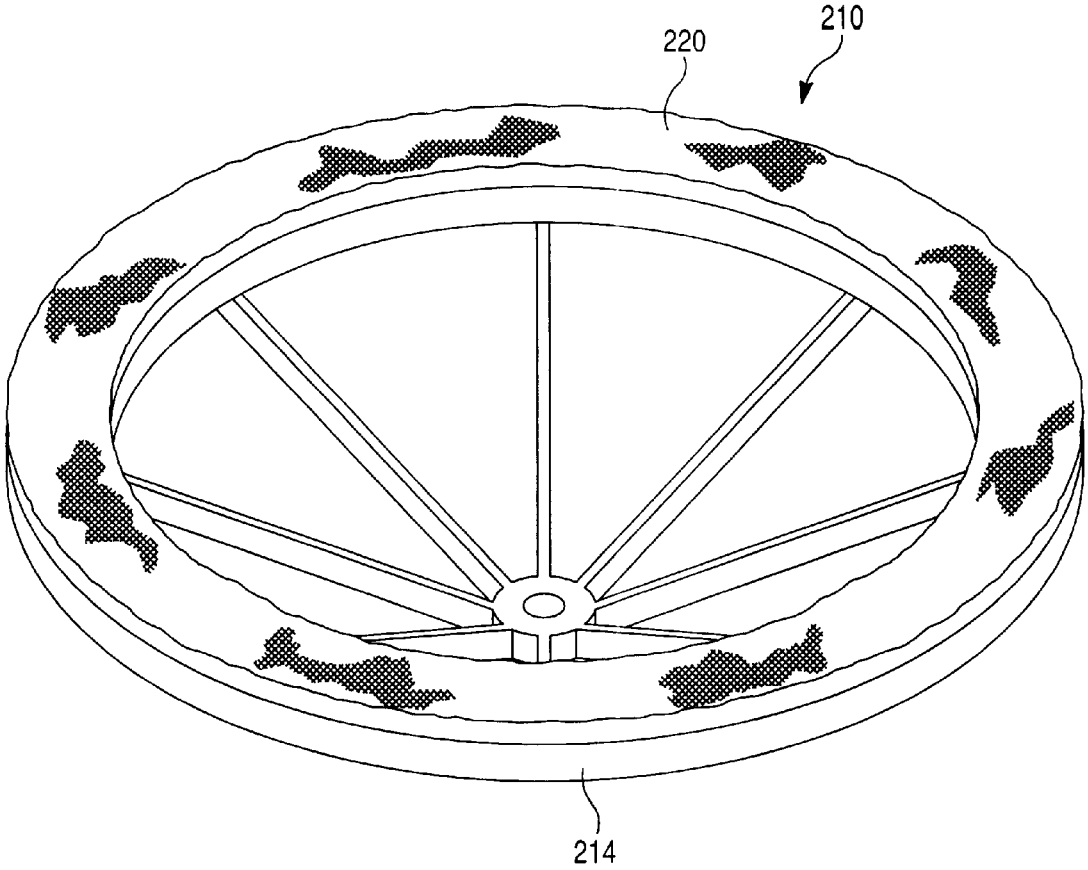
FIG. 5 is a schematic diagram illustrating another embodiment the cymbal damper, in accordance with the present invention.

In the embodiment shown in FIG. 5, the padding is disposed over the entire circumference of the rim 214 and thus engages substantially the entire periphery of the inverted cymbal, completing damping vibration and muting its sound. The mechanical elements used within the hi-hat actuating pedal and the actuator rod are similar to those used in the hi-hats disclosed in U.S. Pat. Nos. 3,185,014 and 5,266,733, the entire disclosures of which are incorporated herein by reference.

The important operative principal behind the cymbal damper of the present invention is that, on a selected upper or lower side of the cymbal, padded or cushioned damping members come into contact with the cymbal at opposite edges, near the periphery and simultaneously. The specific number and arrangement of the contact points may vary depending on the design of the damper and the size and arrangement of the resonating instrument.

Figure 6:
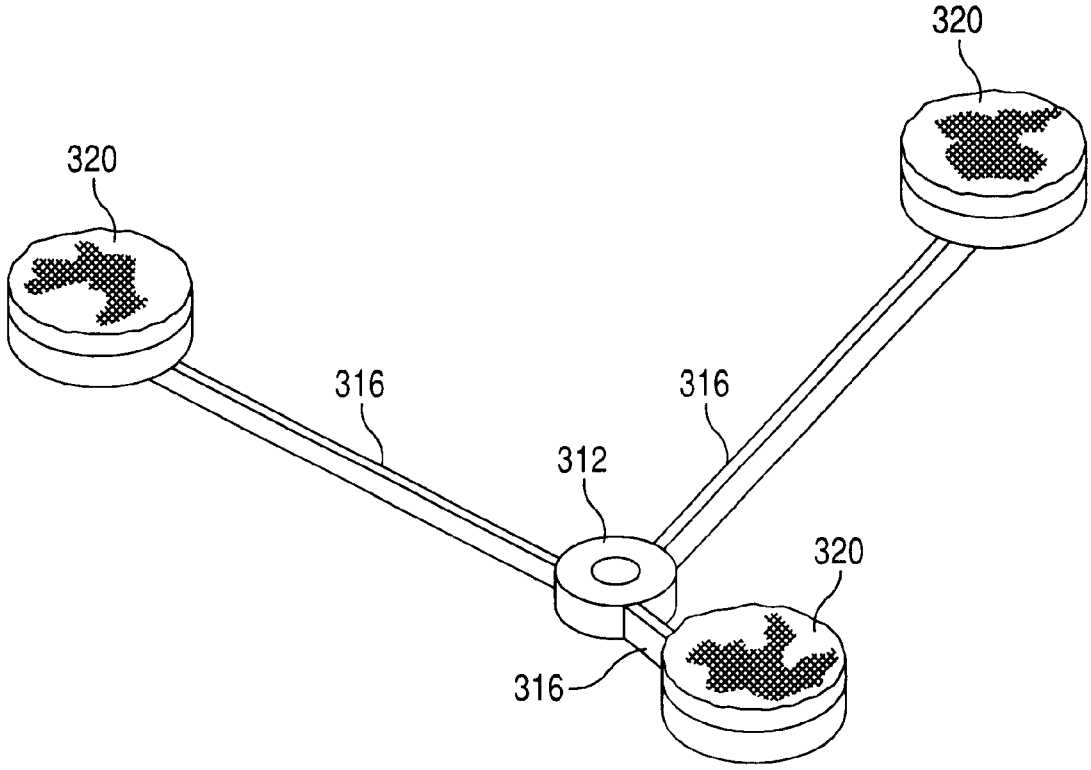
FIG. 6 is a schematic diagram illustrating yet another embodiment the cymbal. damper, in accordance with the present invention.

FIGS. 5 and 6 are schematic diagrams illustrating two exemplary embodiments which operate in accordance with the present invention. In FIG. 5, the vibration damping material 120 of the damping member 210 covers the entire circumference of the rim 214. In FIG. 6, the damping apparatus 310 is formed as an inverted tri-pod including a mounting member 312 at the center of the damping apparatus 310 for mounting the damper in spatial relation with respect to a cymbal. A plurality of support leg 316 extend in a radial direction from the mounting member 312, and a vibration damping material 320 is disposed on the terminal end of each support leg 316. The damping material 320 is adapted to engage the cymbal during operation in the same manner as described with respect to FIGS. 1–4, preferably at the peripheral or free resonating end of the cymbal 1. The vibration damping material 320 is disposed at a plurality of points about a central axis of the cymbal to simultaneous engage and dampen vibration of the cymbal. The modified embodiment of FIG. 6 evidences the versatility of this invention because the shape and arrangement of the damper may take any form to provide more than one point of simultaneous engagement of the vibration dampening material with the resonating instrument. For example, the embodiment of FIG. 6 shows three legs in a tri-pod configuration; however, the specific shape, arrangement and number of support legs 316 may be varied without departing from the spirit, scope and objective of the present invention.

The preferred method for using the cymbal damper of the present invention includes the steps of actuating a foot pedal actuator to bring a cymbal damping structure into contact with a selected upper or lower side of the cymbal, wherein at least two padded or cushioned damping members simultaneously come into contact with the cymbal at opposite edges, near the periphery and damp out or choke the cymbal's vibration.

Figure 7:
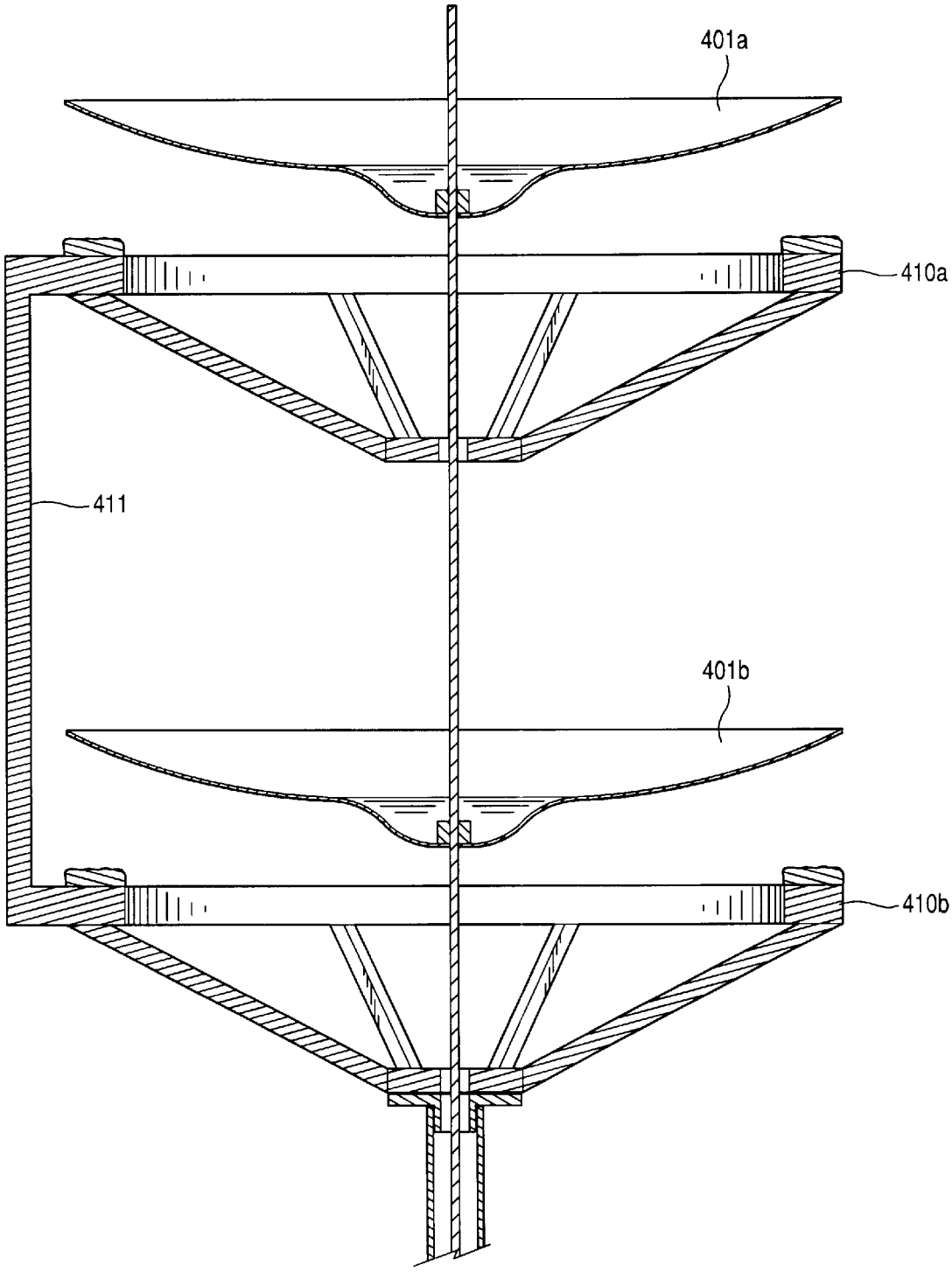
FIG. 7 illustrates, in cross section, the cymbal damping apparatus including a double damper and cymbal arrangement, in accordance with an alternate embodiment of the present invention.

Many modifications are possible with this invention. For example, the preferred embodiment shows a single damper and cymbal arrangement; however, FIG. 7 shows one possible modification where a double damper and cymbal arrangement is provided. The design of FIG. 7 permits the drummer to mount two cymbals 401*a*, 401*b* of the same or different size whereby the two cymbals 4011, 401*b* move together relative to the dampers 410*a*, 410*b*. Here, the dampers 410*a*, 410*b* are interconnected by support 411; however, any suitable structure may be used to mount the upper damper 410*a* relative to damper 410*b*.

Figure 8:
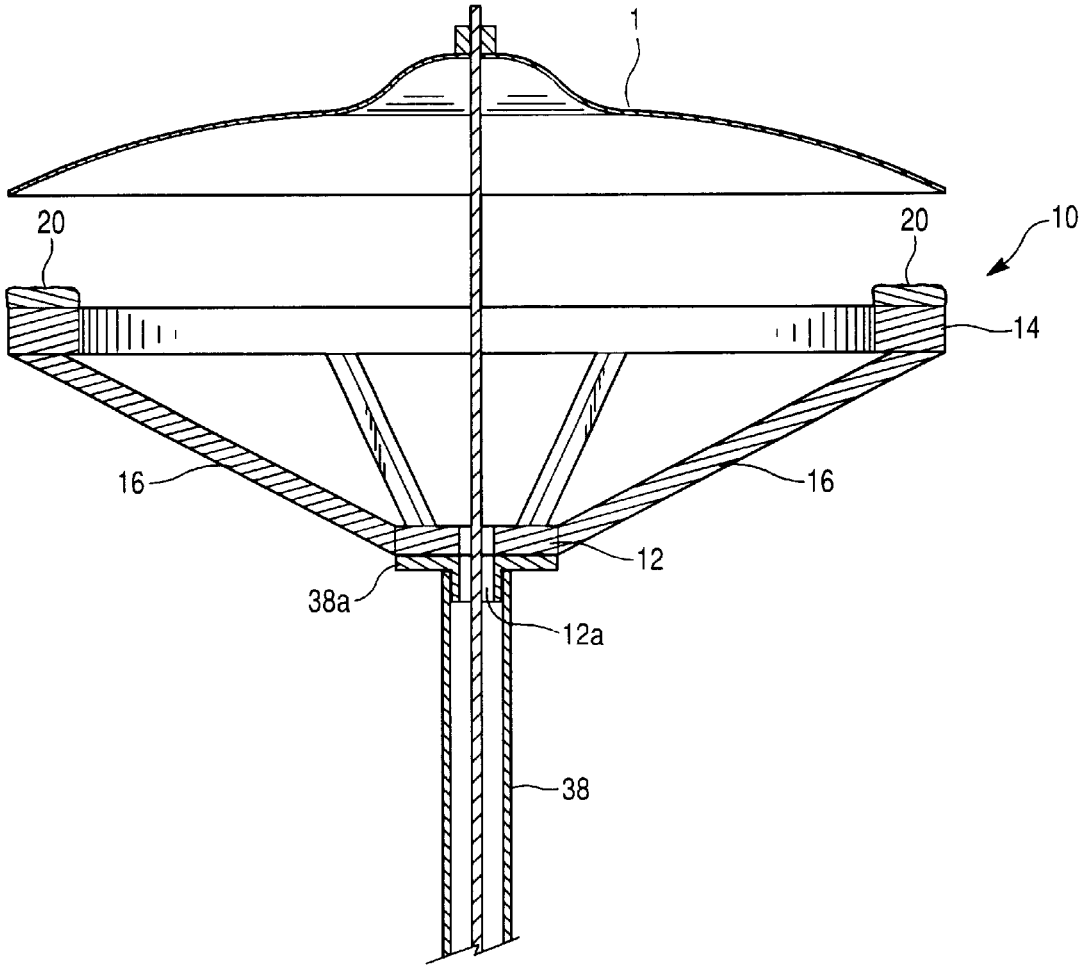
FIG. 8 illustrates, in cross section, the cymbal damping apparatus including the frame member and the cymbal where the cymbal is shown reversed from the position of FIG. 1.

Moreover, the preferred embodiment of this invention shows the cymbal 1, 401 in an inverted position, but the cymbal may be mounted in the traditional position with the concave surface facing downward (see FIGS. 1 and 8).

Having described preferred embodiments of a new and improved method and apparatus, it is believed that other modifications; variations and changes will be suggested to those skilled in the art in view of the teachings set forth herein. It is therefore to be understood that all such variations, modifications and changes are believed to fall within the scope of the present invention. For example, the specific materials chosen for the dampening material 20, 120, 220 may be varied to provide effective absorption of vibration and the materials chosen for the collar, legs and rim of the dampening apparatus 10, 110, 210 may be varied to provide the desired weight, durability, sound and response suitable to a particular drummer's needs. Further, the preferred embodiment provides contact of the vibration dampening material at the periphery of the cymbal; however, effective dampening may be accomplished by contacting selected areas radially inward of the cymbal's periphery.

What is claimed is:

1. A cymbal damping apparatus for damping a resonating cymbal during operation, said apparatus comprising:

a mounting member for mounting said apparatus in spatial relation with respect to a cymbal;

at least one support leg extending in a radial direction from said mounting member; and vibration damping material disposed on said at least one support leg and adapted to engage a cymbal during operation, said vibration damping material being disposed at a plurality of points about a central axis of said cymbal to simultaneously engage said cymbal near its periphery and dampen vibration of said cymbal.

2. The apparatus of claim 1, wherein said plurality of points is equidistant from said central axis.

3. The apparatus of claim 1, wherein said vibration damping material is disposed in a generally circular configuration to match a corresponding circular configuration of said cymbal.

4. The apparatus of claim 3, wherein said generally circular configuration comprises a plurality of arcs uniformly disposed about said central axis.

5. The apparatus of claim 1, wherein said equidistant points define a plurality of discrete points circumscribing said central axis.

6. The apparatus of claim 1, wherein said at least one support leg is disposed at an angle with respect to said mounting member to define a frusto-conical configuration for said mounting member, said support leg and said damping material.

7. The apparatus of claim 1, wherein said damping material is fixed to a rim extending from said support leg.

8. The apparatus of claim 1, wherein said damping material is formed of a material selected from the group consisting of padded terry-cloth fabric, felt, spongy elastomeric material, and foam.

9. A foot operated cymbal damping assembly, which comprises:

a cymbal stand;

a cymbal mounted proximate to the top of said stand;

a cymbal vibration damper positioned on said stand for selective engagement with said cymbal, said vibration damping material being disposed at a plurality of points about a central axis of said cymbal to thereby simultaneously engage said cymbal near its periphery at more than one circumferential location;

a foot pedal positioned proximate to the bottom of said stand to move said cymbal relative to said cymbal vibration damper; and a linkage operatively connecting said foot pedal and at least one of said cymbal and said cymbal vibration damper.

10. The assembly of claim 9, wherein said plurality of points are substantially coplanar and equidistant from said central axis.

11. The assembly of claim 9, wherein said linkage comprises an actuator cable.

12. The assembly of claim 9, wherein said linkage is a substantially rigid actuator rod extending through a generally vertical hollow tube.

13. A method of damping a resonating cymbal, said method comprising the steps of:

providing a vibration dampening material proximate a cymbal, said vibration dampening material being located at a plurality of radial positions about a central axis defined by said cymbal;

selectively adjusting a position of said vibration dampening material relative to said cymbal such that said vibration dampening material simultaneously contacts said cymbal near its periphery to absorb and dampen vibration of said cymbal.

14. The method of claim 13, wherein said step of selectively adjusting includes a step of engaging said cymbal whereby cymbal vibration is immediately and instantaneously damped to silence without a metal-on-metal sound.

* * * * *